US005847814A

United States Patent [19]

Antziopoulos et al.

[11] Patent Number: 5,847,814

[45] Date of Patent: Dec. 8, 1998

[54] COMPONENT CONTROL SYSTEM FOR OFFICE MACHINES HAVING COMPONENTS WITH REGULAR REPLACEMENT INTERVALS

[75] Inventors: Philipp Antziopoulos, Neuss; Hans-Werner Stottmeister, Korschenbroich, both of Germany

[73] Assignee: Toshiba Europa (I.E.) GmbH, Neuss, Germany

[21] Appl. No.: 275,822

[22] Filed: Jun. 19, 1994

[30] Foreign Application Priority Data

Dec. 17, 1991 [DE] Germany ..... 41 41 672.4

[51] Int. Cl.[6] ..... G03G 21/00

[52] U.S. Cl. ..... 355/202; 355/206

[58] Field of Search ..... 355/200, 202, 355/206

[56] References Cited

U.S. PATENT DOCUMENTS 4,961,088 10/1990 Gilliland et al. ..... 355/206

5,115,273 5/1992 Ujiie et al. ..... 355/202 X 5,293,197 3/1994 Iwao ..... 355/208 X 5,325,152 6/1994 Higashio et al. ..... 355/202

5,365,312 11/1994 Hillmann et al. ..... 355/206

*Primary Examiner*—Fred L. Braun

*Attorney, Agent, or Firm*—Nikaido, Marmelstein, Murray & Oram LLP

[57] ABSTRACT

A control system for office machines, in particular copiers or the like, includes a replacement component which must be exchanged after a specific level of use, the system includes at least one detector of level-of-service and a display unit for the level of use associated with the detector to display the level of use and/or any crossing of an upper limit of level of use. The control system further includes a read/write unit for a coded data carrier, in particular a magnetic or chip card, associated with each replacement component to be integrated. Upon introduction of a coded data carrier, the control system shall reset the level-of-use detector. Such a control system lowers the danger of qualitatively inadequate replacement components being installed.

11 Claims, 3 Drawing Sheets

CODED CARD = CC
ENABLING CODE = EC
REPLACEMENT-COMPONENT CODE = RCC

COMPONENT CONTROL SYSTEM FOR OFFICE MACHINES HAVING COMPONENTS WITH REGULAR REPLACEMENT INTERVALS

CROSS REFERENCE TO RELATED APPLICATION

This application is a continuation application of International Patent Application No. PCT/EP92/02921, filed Dec. 16, 1992, designating the United States.

The invention concerns a control system for office machines, in particular copiers or the like, comprising at least one replacement component, ie, a component which because of use will deplete and/or wear out and then be replaced, which will be exchanged following a given level of use and further at least one detector for the level of use and a related display of the level of use and/or of the level of use having been exceeded.

A problem arises with office machines of the above kind comprising an replacement component which is exchanged following a specified level of use in that in many instances the newly inserted replacement component does not meet the manufacturer specifications for proper operation. Illustratively this is the case for those modern copiers operating electrophotographically and wherein, following a predetermined number of copies, the photoconducting drum, the fixing drums as well as the wipers must be changed to assure minimum copy quality and to preclude permanently degrading the copying process. Presently it is left to the user of the copier being informed by a display, for instance a copy counter, that the number of copies made since the last change of the replacement component is being exceeded, whether or not to have the replacement component changed by service personnel. If the time of operation substantially exceeds the rated life of replacement components, consequential damages may be incurred by other replacement components or the apparatus may be permanently damaged. Moreover, under present conditions, it is exceedingly difficult for the manufacturers of replacement components to obtain information about statistical quality and actual life of such articles. Heretofore the copier user has not been protected against the installation of nonoriginal replacement components or replacement components released by others than the manufacturer. Again as regards other office machines with replacement components such as printers or plotters with printing or drawing heads as such parts, there is danger of introducing qualitatively inadequate replacement parts or that such parts be used too long.

The object of the invention is to create a control system for office machines, in particular copiers or the like, of the initially cited kind, which shall substantially reduce the danger unrecognized by the user, of introducing poor quality replacement components.

This problem is solved in that a read/write device is provided for a coded data carrier associated with each replacement component to be installed, in particular a magnetic or chip card, and in that the control system resets the detector of the level of use when a coded data carrier is brought near.

The user of the office machine is easily able to monitor the resetting of the detector of level of use, namely by checking the display (for instance a copy counter or an alarm in the case of exceeding a predetermined number of copies or the time of use). However resetting assumes on one hand the presence of the coded data carrier which shall be added by the manufacturer solely to its own replacement parts or to those of other suppliers released following quality control by said manufacturer. Coded data carriers, in particular magnetic or chip cards, can be economically made to be forgery-proof. On the other hand the resetting assumes a read/write unit which in an advantageous embodiment mode of the invention may be a separate part selectively connected to the office machine. In that case this read/write unit may be restricted to authorized service personnel. In the event a predetermined upper limit of copies has been reached and that there is ensuing automatic shutdown of the copying mechanism (opening a main switch), the invention precludes any further use with the replacement component. Only after the resetting of the corresponding detector related to the exchange of said article will it be possible to again operate the office machine.

In an alternative embodiment mode of the invention, the read/write unit also may be permanently affixed to the office machine which then preferably may be designed to read from and/or write on user data carriers. Such user data carriers may be counting (job memory) cards storing the numbers of copies associated with a particular user, or they may be apparatus-setting (editor) cards storing apparatus settings or specific programs.

In an especially preferred further development of the invention, feeding a coded data carrier into the read/write unit will cause the control system to read an enabling code and to check its validity and to reset the detector of the level of use only in case of validity. This procedure assures resetting the detector of level of service solely by means of coded data-carriers specifically provided for that purpose by the manufacturer. In an especially preferred further step, after having checked the validity of the enabling code when a coded data-carrier is fed into the read/write unit, the control system will erase or overwrite said enabling code in a later procedure. This particular step assures that a coded data-carrier can be used only once for resetting.

In a further embodiment mode of the invention, the read/write unit is a separate apparatus selectively connected to the office machine. In this manner the various levels of use of the different replacement components can be taken into account. Each replacement component then can in fact be utilized to its admissible limit of use.

The invention proposes furthermore to design the read/write unit to read from and/or write on user data-carriers, in particular counting or apparatus-settings cards. This design allows simple information feedback to the manufacturer, because following assembly of the particular replacement component, the coded data-carriers can be easily returned to the manufacturer's information-gathering facility. At least as regards substantial replacement components such as photoconducting drums, these components also are returned to the manufacturer for reprocessing or waste disposal, as a result of which the manufacturer can ascertain the total output in number of copies of the particular component being returned by means of the coded data-carrier that was returned simultaneously. This information is highly significant for the on-going improvement and further development of office machines because providing statistics on the life and reliability of the replacement components.

Moreover the coded data-carrier may be designed for the feedback of further important information, in particular for the feedback of the current use-count in a total-use detector (for instance the total number of copies) of the office machine or the current count in a detector for malfunctions, in particular paper jams or for proper operation, for instance the use of different trays or of different reproduction sizes.

The latter information is used in further developing the office machines in user-friendly manner.

The invention is elucidated below by a preferred embodiment mode shown in the drawing.

The control system of the invention is elucidated below in relation to a conventional copier, even though it also may be applied to other office machines as well. However the advantages of the invention are especially obvious in a copier, since such apparatus requires fairly frequent exchange of comparatively costly components.

Figure 1:
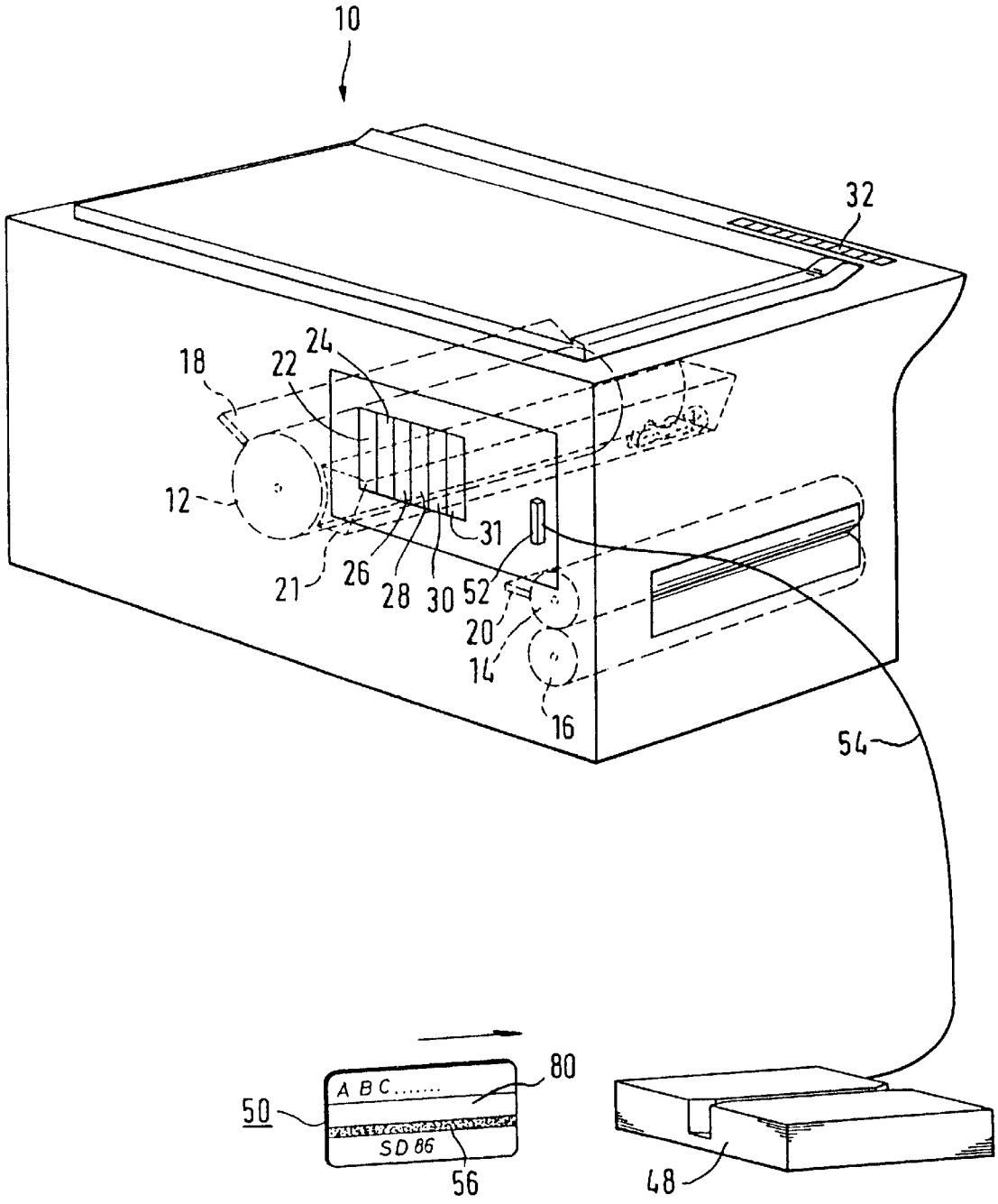
FIG. 1 is a simplified perspective overview of a copier fitted with the control system of the invention.

The overall copier of FIG. 1 is denoted by 10. The design of the copier is shown only to the extent involving replacement components and parts of the control system. A photoconducting drum 12 indicated by dot-dash lines is such a replacement component requiring exchange following a level of level-of-use of 20 to 200 thousand copies depending on design. An upper fixing roller 14 and a lower fixing roller 16 must be changed following about 100 thousand copies. A cleaning wiper 18 for the photoconductive drum 12 and a cleaning wiper 20 for the upper fixing roller 14 require changing after about 80 thousand copies. Again the limit of level-of-use will vary from one type of apparatus to another for the developer 21. If the particular replacement component is exchanged too late. Copy quality will suffer; moreover, copying may be permanently degraded thereby. If changing is premature, unnecessary costs are incurred by the user.

Figure 2:
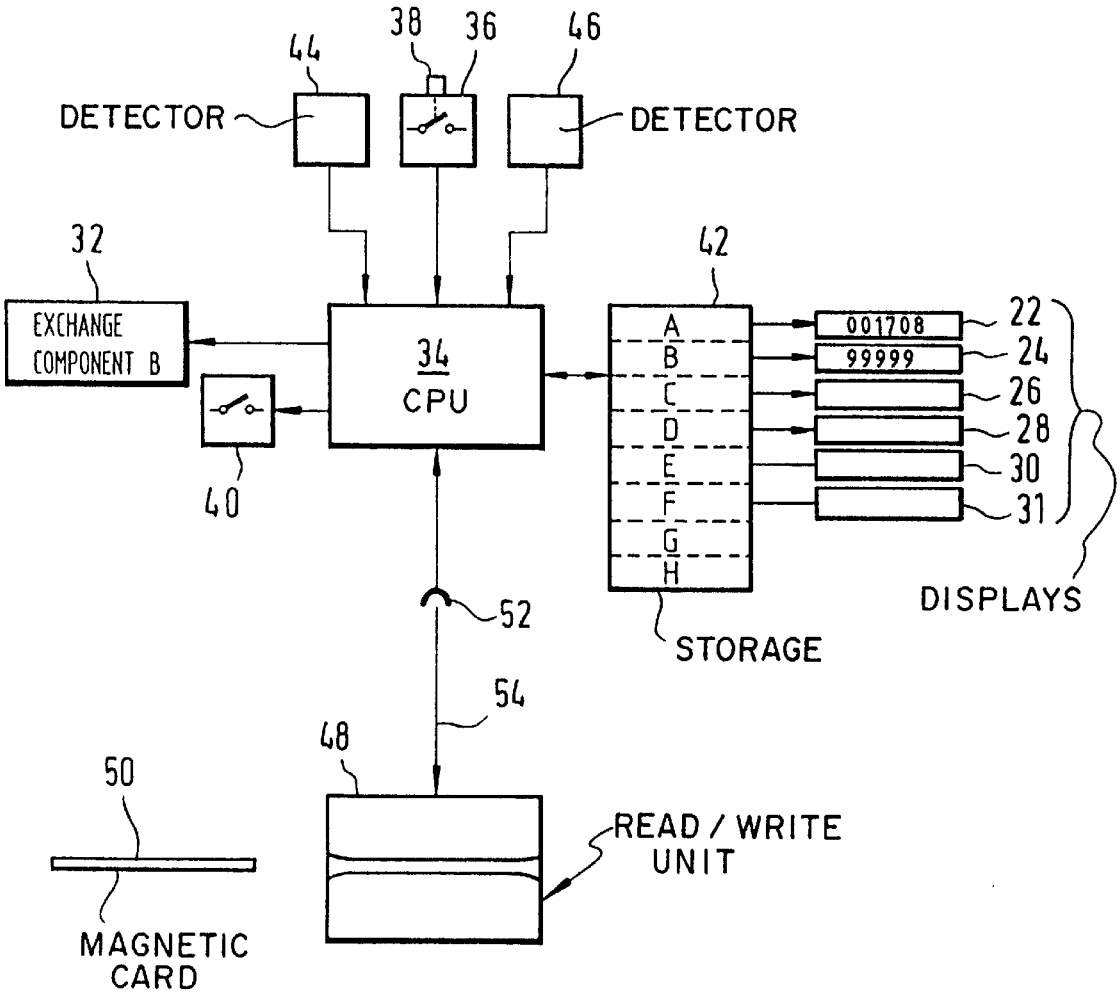
FIG. 2 is a block diagram of the control system.

In order to change these replacement components individually depending on the particular rated service life (number of copies), each replacement component is associated with its own level-of-use detector (in this instance in the form of a copy counter). The copy counter may be mechanical, electromechanical or electronic. To monitor the particular level-of-use status, a copy-number display is associated with each detector and hence with each of said replacement components. The display for the photoconducting drum 12 is denoted by 22, that for the upper fixing roller 14 by 24, that for the fixing roller 16 by 26, and those for the cleaning wipers 18 and 20 by 28 and 30 resp. and that for the developer 21 by 31. In addition, or alternatively, a display 32 may be provided to signal that the level-of-use limit is or has been exceeded, in particular being in the form of an alarm as indicated in FIGS. 1 and 2. The alarm may be optical and/or acoustic if a maximum admissible number of copies of a replacement component is being reached or already has been exceeded. The alarm may provide instructions on how to remedy the difficulty, in the manner shown in FIG. 2 by the display "exchange component B". These displays 22 through 32 are controlled from a central unit (CPU) 34 receiving the pulses counting the number of copies for instance from a copy-trigger switch 36 actuated by a key 38 indicated in FIG. 2 and pushed by the copier operator. For that purpose the CPU 34 is designed in relation to the nature of the copier 10 and, where called for, in addition also to open a main equipment switch 40 of the copier and thereby to constrain shutdown of the copier 10 if an absolute upper limit of the number of copies is being exceeded in an operationally important replacement component, especially the photoconducting drum 12.

In the case of the electronic design for the individual level-of-use detectors (for simplicity hereafter called counters), particular storage areas A through F inside an electronic storage 42 indicated in FIG. 2 are assigned to the individual replacement components, said storage 42 being driven by the CPU 34. Furthermore detectors for other characteristic level-of-use data may be connected to the CPU 34, for instance a detector 44 for malfunctions such as paper jams and a detector 46 for proper operational states such as relating to the use of different paper trays or for different reproduction sizes. These detectors 44, 46 in turn are associated with their own storage areas G and H.

A read/write unit 48 for magnetic cards 50 can be connected to the CPU 34. In the shown embodiment mode, this read/write unit 48 is separate and is entrusted to authorized customer service personnel; it can be connected electrically by a plug-in connector 52 to the CPU 34. FIG. 1 shows a hook-up cable 54 of the unit 48.

Instead of the shown magnetic card 50 with printed magnetic strip 56, other coded data-carriers also may be used, for instance integrated-chip cards.

Figure 3:
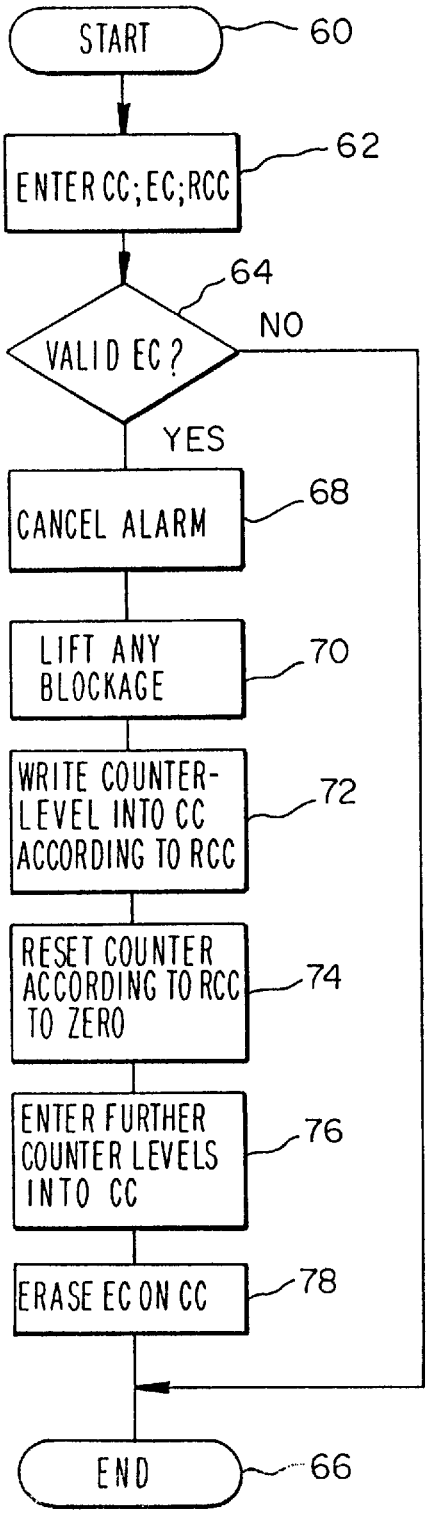
FIG. 3 is the program-sequence for the control system.

In the program sequence shown in FIG. 3, the magnetic card 50 is denoted by CC (for coded card). Among others, the following data are also stored in this storage area (magnetic strip 56): enabling code EC from the office-machine manufacturer and replacement component code RCC indicating the replacement component that was associated with the magnetic card 50 by the component manufacturer.

The control system of the invention is elucidated below by means of the operational diagram of FIG. 3.

The user of the copier 10 is continually informed by the display units 22–31 about the particular level-of-use stages of all replacement components 12–21. As soon as the user notices that a predetermined upper limit of number of copies has been exceeded for a given replacement component, for instance by the display unit 32 as shown in FIG. 2 requiring the exchange of a particular replacement component (in this instance B), said user shall notify the pertinent customer service to exchange the relevant replacement component. In the extreme case the user shall be forced to call customer service when the main switch 40 automatically shuts down the copier 10.

Following replacement of the replacement component, customer service will insert the magnetic card 50 adjoined by the manufacturer to each authorized replacement component into the read/write unit 48 to reset to null the pertinent display units 22–31 in a way obvious to the user, where called for cancelling any alarm displayed by the display 32 and where necessary closing the main switch 40.

After the magnetic card 50 has been inserted into the read/write unit 48, the program sequence of FIG. 3 will be carried out. A start block 60 is followed by a block 62 comprising the memorization of the enabling code EC and the replacement-component code RCC. The enabling code EC is checked in the subsequent decision block 64. If the enabling code EC is improper or missing, the program jumps to the program end in front of the end block 66. In this case no display at all will be reset, nor will any alarm be cancelled or the main switch be closed.

If on the other hand the enabling code is found valid, the program continues in the block 68 which cancels the alarm. In the ensuing block 70 any blocking feature (opened main switch 40) will be canceled. In the next block 72 the copies counter level associated with the exchanged replacement component is read out of electronic memory 42 in the manner shown in FIG. 2 and is written by the read/write unit 48 onto the magnetic card 50. Thereupon this counter level is set to null in the following block 74, whereby the associated display also shall display henceforth "zero copies"). Further counter levels can be written in the following block 76 onto the magnetic card 50, in particular the absolute number of copies since the office machine 10 was started for the very first time. In this process the properly functioning conditions and the malfunctions ascertained by the said detectors 44 and 46 can be retrieved from storage. Conceivably these counter levels also go back to the very first start. However relative counter levels also may ascertained by nulling the associated counters after each exchange of a replacement component. In that instance, the data concerning the last counter nulling must be written onto the magnetic card 50.

The enabling code EC on the magnetic card 50 is erased in the next block 78, and as a result the magnetic card 50 can be used only once in the above described manner. The end block 66 follows block 78.

The magnetic card 50 may be fitted with an inscription zone 80 where the service personnel can enter the serial number of the copier 10, the date of exchange and its identification number.

Accordingly the status-data of the copier 10 and of the exchange replacement component are stored on the magnetic card 50. Together with the exchanged replacement component, the magnetic card 50 is returned to the manufacturer or to customer service for the purpose of reprocessing or of waste disposal and also to let the manufacturer analyze the data stored on the magnetic card. By statistical analysis of these data the manufacturer is able to collect information on the average life of the particular replacement components and also on copier reliability. Such information is used in the further development of the copiers and of their replacement parts.

We claim:

1. A control system for office machines which include at least one component which becomes depleted and requires replacement after a specific level of use, said control system comprising:

a control means for controlling operational elements of said control system;

at least one level-of-use detector coupled to said control means for determining a level of use of the at least one component;

a level-of-use display coupled to said level-of-use detector for displaying the level of use, and for indicating when a predetermined limit, indicating the specific level of use, is exceeded;

a read/write unit coupled to said control means for reading a coded data carrier, said coded data carrier being associated with a replacement component to be installed to replace the component having exceeded the specific level of use;

the coded data carrier including an enabling code thereupon which is read by said read/write unit, said enabling code enabling said control means to reset the level-of-use detector, wherein upon reading the enabling code, the control means directs the read/write unit to overwrite the enabling code on the coded data carrier.

2. A control system as recited in claim 1, wherein the read/write unit is a separate unit selectively connectable to the office machine.

3. A control system as recited in claim 1, wherein the read/write unit reads from user data-carriers.

4. A control system as recited in claim 3, wherein the read/write unit writes on user data-carriers.

5. A control system as recited in claim 1, wherein a separate level-of-use detector is associated with each replacement component of a plurality of replacement components of the office machines, each of said plurality of replacement components having different limits of use, and wherein when the coded card carrier is inserted, the control means initiates reading a replacement-component code and resets a corresponding level-of-use detector which is associated with a replacement component corresponding to the replacement-component code RCC.

6. A control system as recited in claim 1, wherein when a coded data-carrier is inserted, the control means ascertains a current level of use of the particular level-of-use detector before resetting the level-of-use detector and stores said current level of use on the coded data carrier.

7. A control system as recited in claim 1, wherein when a coded data-carrier is inserted into the read/write unit, the control means ascertains the current level of use of a level-of-use detector for a total level-of-use of the office machine and stores it on the coded data carrier.

8. A control system as recited in claim 1, wherein when a coded data carrier is inserted into the read/write unit, the control means ascertains the current status of a detector for malfunctions, and stores said status on the coded data carrier.

9. A control system as recited in claim 1, wherein when the coded data carrier is inserted into the read/write unit, the control means ascertains the current status of a detector for proper operational conditions and stores said status on the coded data carrier.

10. A control system as recited in claim 1, wherein said coded data carrier comprises a magnetic card.

11. A control system as recited in claim 1, wherein said coded data carrier is a chip card.

* * * * *